US010612561B2

(12) United States Patent
Haag et al.

(10) Patent No.: US 10,612,561 B2
(45) Date of Patent: Apr. 7, 2020

(54) INTEL NOZZLE FOR A RADIAL FAN

(71) Applicant: ebm-papst Mulfingen GmbH & Co. KG, Mulfingen (DE)

(72) Inventors: Christian Haag, Kuenzelsau (DE); Erhardt Gruber, Satteldorf (DE); Oliver Haaf, Kupferzell (DE); Konrad Schmitt, Krautheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 141 days.

(21) Appl. No.: 15/705,630

(22) Filed: Sep. 15, 2017

(65) Prior Publication Data

US 2018/0094641 A1 Apr. 5, 2018

(30) Foreign Application Priority Data

Oct. 5, 2016 (DE) ..... 10 2016 118 856

(51) Int. Cl.

| | |
|---|---|
| ***F04D 29/44*** | (2006.01) |
| ***F04D 29/42*** | (2006.01) |
| ***F04D 29/66*** | (2006.01) |
| ***F04D 17/16*** | (2006.01) |

(52) U.S. Cl.

CPC ..... *F04D 29/441* (2013.01); *F04D 29/4213* (2013.01); *F04D 29/667* (2013.01); *F04D 17/16* (2013.01)

(58) Field of Classification Search

CPC .... F04D 17/16; F04D 29/4213; F04D 29/441; F04D 29/541; F04D 29/545; F04D 29/667; F04D 29/681; F04D 29/422; F05D 2250/51

USPC ..... 415/58.3

See application file for complete search history.

(56) References Cited

U.S. PATENT DOCUMENTS 6,499,948 B1 12/2002 Iyer et al.

FOREIGN PATENT DOCUMENTS

| | | | | |
|---|---|---|---|---|
| DE | 4222131 A1 * | 1/1994 | ..... | H02K 9/04 |
| DE | 200 01 746 U1 | 7/2001 | | |
| DE | 10 2012 021 372 A1 | 4/2014 | | |
| DE | 10 2015 207 948 A1 | 11/2016 | | |

OTHER PUBLICATIONS

German Search Report dated Aug. 8, 2017, 7 pages.

* cited by examiner

*Primary Examiner* — Moshe Wilensky
*Assistant Examiner* — Andrew Thanh Bui
(74) *Attorney, Agent, or Firm* — Dickinson Wright PLLC

(57) ABSTRACT

The invention relates to an inlet nozzle for a radial fan, having a plurality of flow sections defined over the wall of the inlet nozzle (1), as viewed in the direction of flow, said flow sections comprising at least: an inlet section (2) which has an inlet opening (7), a perturbation section (3) directly adjoining the inlet section (2), and an outlet section directly adjoining the perturbation section (3), wherein the flow cross-section of the inlet nozzle (1) decreases in the inlet section (2), and wherein the perturbation section (3) that is formed between the inlet section (2) and the outlet section (4) is designed as cylindrical over its entire axial length and extends parallel to the rotational axis of the inlet nozzle (1), so that the flow cross-section of the inlet nozzle (1) is constant in the perturbation section (3).

10 Claims, 4 Drawing Sheets

INTEL NOZZLE FOR A RADIAL FAN

Figure 1:
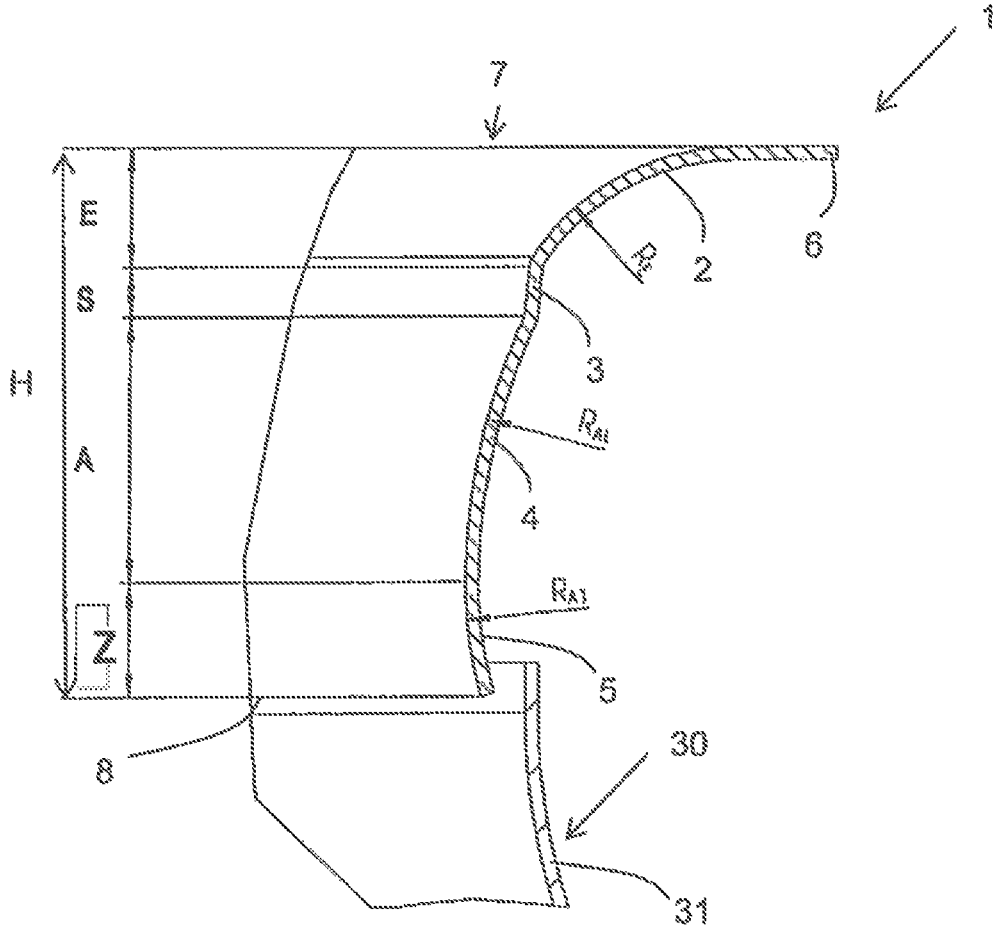

The invention relates to an inlet nozzle for a radial fan.

Inlet nozzles of the type in question are known from prior art document EP 1122444 B1, for example. Said document discloses an inlet nozzle for an impeller of a radial fan that has a perturbation element on its wall, which is formed without an undercut. This design is based on the fact that sound is caused by localized pressure fluctuations in the flow of air, which are in turn caused by separation phenomena or by intense changes in the speed of the air flow. The boundary layer on the nozzle wall, which is widened by the perturbation element, causes a lower velocity gradient in the balance between the flow of air emerging from the inlet nozzle and the flow of air emerging in the gap between the inlet nozzle and the impeller. Because the velocity gradient is proportional to the interacting forces acting on the air molecules, it has a direct impact on sound output. These interacting forces on the air molecules are in turn proportional to the acoustic output and thus to the noise level.

It is accordingly known that disrupting the flow in the inlet nozzle will improve its noise performance. In the prior art, perturbation contours are provided in the form of corrugation. Introducing such contours into the inlet nozzle is relatively costly, thus the need for a simpler solution in terms of manufacturing exists.

In light of the above, it is therefore the object of the invention to provide an inlet nozzle that is easy to produce and that effectively reduces noise emissions with low manufacturing effort, without significant losses in terms of the air performance of the connected fan.

This object is achieved by the combination of features according to claim 1.

According to the invention, an inlet nozzle for a radial fan is proposed, which has a plurality of flow sections defined over the wall of the inlet nozzle, as viewed in the direction of flow, said flow sections comprising an inlet section E which has an inlet opening, a perturbation section S directly adjoining the inlet section, and an outlet section A directly adjoining the perturbation section. The flow cross-section of the inlet nozzle decreases in the inlet section. The perturbation section formed between the inlet section and the outlet section is designed as cylindrical over its entire axial length and extends parallel to the rotational axis of the inlet nozzle, so that the flow cross-section of the inlet nozzle is constant in the perturbation section.

All of the flow sections mentioned in the present disclosure are defined by the shape of the inner wall of the inlet nozzle facing the flow. The inlet nozzle is preferably funnel-shaped and rotationally symmetrical about the rotational axis.

The cylindrical shape of the inlet nozzle wall in the perturbation section is easier to manufacture than the corrugation of the prior art. The transition between the flow cross-section of the inlet section, which decreases in the direction of flow, and the perturbation section with its cylindrical shape generates the noise-reducing perturbation of the flow through the inlet nozzle. According to the invention, it has been found that merely shaping the perturbation section, which adjoins the tapered inlet section, in the form of a cylinder will impact the flow sufficiently to ensure at least the same perturbation as is achieved in the prior art using corrugation.

In one embodiment it is provided that, of the flow sections, only the perturbation section is designed as cylindrical in shape and extending parallel to the rotational axis of the inlet nozzle. This means that after the flow of air through the inlet nozzle passes the perturbation section, it is influenced by another modified shape of the inner wall in the outlet section. In one advantageous embodiment, the transition from the inlet section to the perturbation section and the transition from the perturbation section to the outlet section are discontinuous. The discontinuous transition generates increased turbulence between the inlet section, the perturbation section, and the outlet section, while at the same time inhibiting a separation of the boundary layer.

Further advantageous is a refinement in which the flow cross-section of the inlet nozzle decreases in the outlet section, i.e. the wall of the outlet section extends at least progressively toward the rotational axis. Favorable in this connection is an embodiment in which the outlet section extends convergent over its entire axial length in the direction of flow with the rotational axis of the inlet nozzle.

Further advantageous is an embodiment of the inlet nozzle in which the inlet section, which tapers in the direction of flow, has a rounded contour as viewed in axial cross-section. The inlet section also advantageously has a continuous profile as viewed in the direction of flow.

In a refinement of the inlet nozzle, it is provided that the outlet section has a plurality of adjoining sub-sections in the direction of flow, with at least one of the sub-sections having a rounded contour as viewed in axial cross-section. Both sub-sections, however, advantageously extend convergent with the rotational axis.

Furthermore, in one embodiment the inlet nozzle comprises discharge section Z as an additional flow section, which directly adjoins the outlet section as viewed in the direction of flow and which also forms the discharge opening of the inlet nozzle. The flow cross-section of the discharge section, which advantageously diverges from the rotational axis of the inlet nozzle in the direction of flow, increases in the direction of flow (diffuser shape), giving the inlet nozzle a Venturi shape over its axial extension.

Also advantageously in terms of aerodynamics, the transition from the outlet section to the discharge section follows a continuous profile.

Particularly favorable results are achieved with the inlet nozzle in terms of noise performance and in terms of the output of the connected radial fan if the size ratio of the axial inlet height E of the inlet section to the overall axial height H of the inlet nozzle is set within a range of $0.15 \leq E/H \leq 0.30$, more preferably is set at 0.2-0.25, and even more preferably is set at 0.22.

Additionally or alternatively, an advantageous geometric configuration of the inlet nozzle is one in which the size ratio of the axial perturbation height S of the perturbation section to the overall axial height H of the inlet nozzle is set within a range of $0.08 \leq S/H \leq 0.14$, more preferably is set at 0.09-0.11, and even more preferably is set at 0.1.

A further advantageous geometric configuration of the inlet nozzle is one in which the size ratio of the axial outlet height A of the outlet section to the axial discharge height Z of the discharge section of the inlet nozzle is set within a range of $1.8 \leq A/Z \leq 2.8$, more preferably is set at 2.2-2.4, and even more preferably is set at 2.30.

Figure 2:
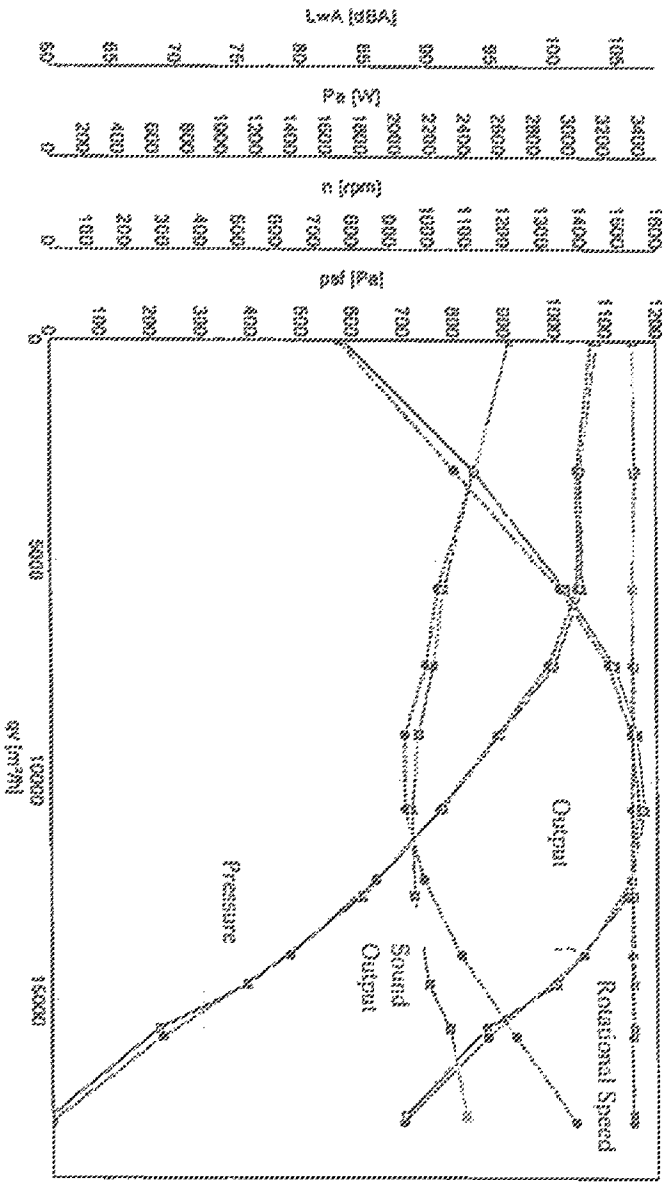
Figure 3:
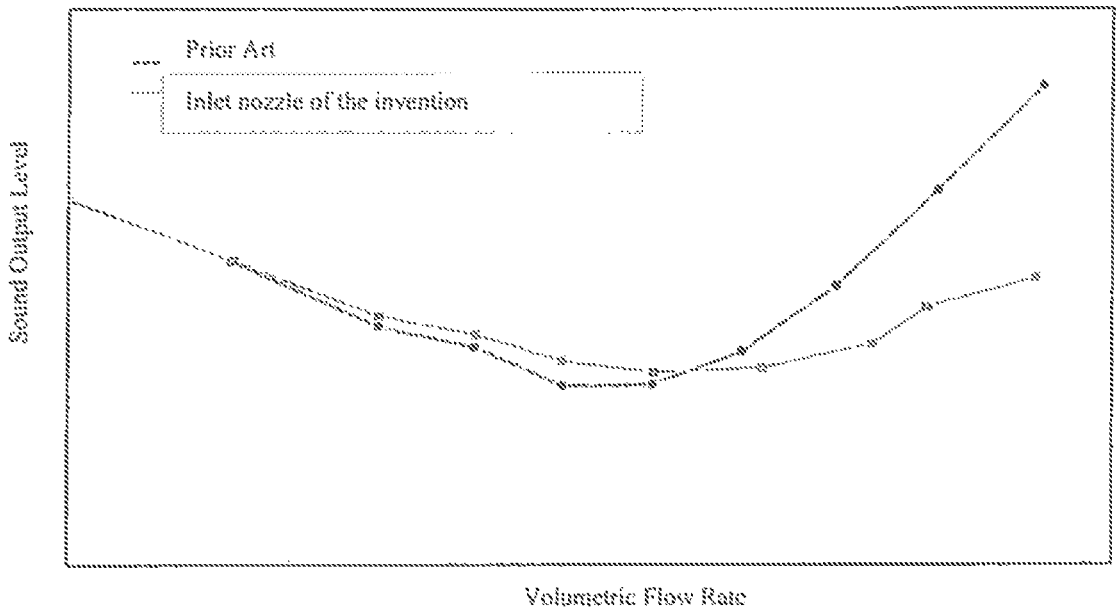
Figure 4:
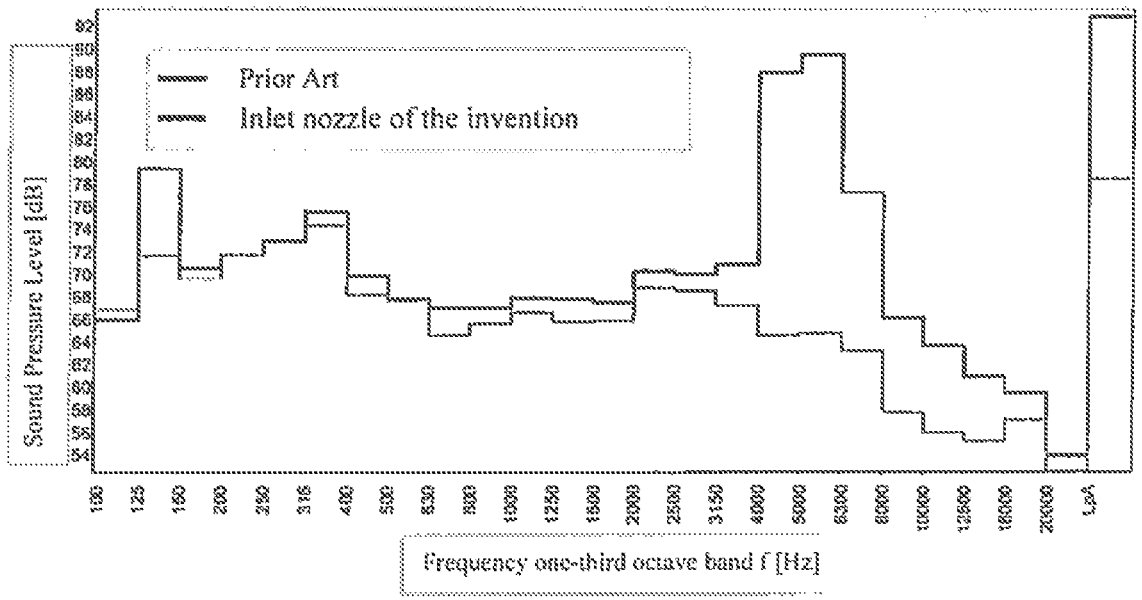

All of the disclosed features can be combined as required, provided this is technically feasible and not contradicted. Further advantageous refinements of the invention are specified in the sub-claims and/or are described more fully in the following, together with a description of the preferred embodiment of the invention, with reference to the drawings. The drawings show:

FIG. 1 an axial cross-section of a portion of an inlet nozzle according to the invention, disposed on an impeller;

FIG. 2 a line graph showing the results obtained from the inlet nozzle of FIG. 1;

FIG. 3 a view of the details of the sound output from FIG. 2;

FIG. 4 a chart illustrating the sound pressure level of the inlet nozzle from FIG. 1.

FIG. 1 shows an exemplary embodiment of a rotationally symmetrical, funnel-shaped inlet nozzle 1, disposed on an impeller 30, in axial cross-section, in which only the details of the wall are represented for the purpose of illustrating the flow sections. Of impeller 30, primarily the cover plate 31 is visible.

As flow sections, inlet nozzle 1 comprises inlet section 2 which determines inlet opening 7, perturbation section 3 which immediately adjoins inlet section 2, outlet section 4 which immediately adjoins perturbation section 3, and discharge section 5 which immediately adjoins outlet section 4 and forms discharge opening 8. Inlet section 2 transitions at its axial edge into a mounting flange 6, the shape of which can be variably rounded or angular.

The flow cross-section of inlet nozzle 1 in the flow sections is determined by the geometric shape of the wall in each case. In the embodiment shown, the shape of the outer wall corresponds to the shape of the inner wall in each case, but the flow cross-section is defined solely by the shape of the inner wall. In inlet section 2, the flow cross-section decreases, with the wall having an elliptical curvature $R_E$ as viewed in cross-section. Perturbation section 3, which adjoins inlet section 2, is circumferentially cylindrical over its entire axial length and extends parallel to the rotational axis of inlet nozzle 1. The flow cross-section of inlet nozzle 1 is constant in perturbation section 3. Outlet section 4, which adjoins perturbation section 3, likewise has a curvature $R_{AL}$ that decreases the flow cross-section, as viewed in the cross-section of FIG. 1, however this curvature is more modest than the curvature $R_E$ of inlet section 2. Outlet section 4 extends convergent with the rotational axis of inlet nozzle 1. Discharge section 5, which enlarges the flow cross-section, immediately adjoins outlet section 4 with a continuous transition, and has a curvature $R_{AT}$ directed radially outward, giving the entire inlet nozzle 1 a Venturi shape.

The profiles of the individual flow sections 2, 3, 4, 5 are each continuous, whereas the transitions between inlet section 2 and perturbation section 3 and between perturbation section 3 and outlet section 4 are discontinuous.

In the embodiment variant shown, the size ratio of the axial inlet height E of inlet section 2 to the overall axial height H of inlet nozzle 1 has a value of 0.22. The size ratio of the axial perturbation height S of perturbation section 3 to the overall axial height H has a value of 0.10. Finally, the size ratio of the axial outlet height A of outlet section 4 to the axial discharge height Z of discharge section 5 of inlet nozzle 1 has a value of 2.30.

Inlet nozzle 1 as shown in FIG. 1 achieves the improved noise values (sound output), depicted in the line graphs of FIGS. 2 and 3, over prior art inlet nozzles that have no perturbation section, without appreciable changes in the values for pressure, rotational speed, and output of an identical radial fan connected thereto. The values for the prior art are indicated in each case by squares, and those for the inlet nozzle 1 are indicated by dots. As is clear from FIG. 3, particularly at high volumetric flow rates, noise performance improves, i.e. the sound output level is reduced. This is also clear from the frequency one-third octave band chart of FIG. 4 showing the sound pressure level of inlet nozzle 1 from FIG. 1, in which a significant reduction in the sound pressure level occurs at frequency levels of 125-160 and 4,000-8,000 Hz.

The invention claimed is:

1. An inlet nozzle for a radial fan having a plurality of flow sections defined over a wall of the inlet nozzle (1), as viewed in a direction of flow, said flow sections comprising at least: an inlet section (2) which has an inlet opening (7), a perturbation section (3) directly adjoining the inlet section (2), and an outlet section directly adjoining the perturbation section (3), wherein the flow cross-section of the inlet nozzle (1) decreases in the inlet section (2), characterized in that the perturbation section (3) that is formed between the inlet section (2) and the outlet section (4) is designed as cylindrical over its entire axial length and extends parallel to a rotational axis of the inlet nozzle (I), so that the flow cross-section of the inlet nozzle (1) is constant in the perturbation section (3), wherein the flow cross-section of the inlet nozzle (1) decreases in the outlet section (4), and wherein the inlet nozzle further comprises a discharge section (5) that forms a discharge opening (8) and directly adjoins the outlet section (4) as viewed in the direction of flow, said discharge section diverging from the rotational axis of the inlet nozzle (1) in the direction of flow with the flow cross-section thereof increasing in the direction of flow; and characterized in that the outlet section (4) extends convergent with the rotational axis of the inlet nozzle (1) in the direction of flow.

2. The inlet nozzle according to claim 1, characterized in that of the flow sections, only the perturbation section (3) is designed as cylindrical and extends parallel to the rotational axis of the inlet nozzle (1).

3. The inlet nozzle according to claim 1, characterized in that the inlet section (2), which tapers in the direction of flow, has a rounded contour as viewed in axial cross-section.

4. The inlet nozzle according to claim 1, characterized in that the inlet section (2) has a continuous profile as viewed in the direction of flow.

5. The inlet nozzle according to claim 1, characterized in that the transition from the inlet section (2) to the perturbation section (3) and the transition from the perturbation section (3) to the outlet section (4) are discontinuous.

6. The inlet nozzle according to claim 1, characterized in that in the direction of flow, the outlet section (4) has a plurality of sub-sections, adjoining one another in the direction of flow, wherein at least one of the sub-sections has a rounded contour as viewed in axial cross-section.

7. The inlet nozzle according to claim 1, characterized in that the transition from the outlet section (4) to the discharge section (5) has a continuous profile.

8. The inlet nozzle according to claim 1, characterized in that a size ratio of an axial inlet height E of the inlet section (2) to an overall axial height H of the inlet nozzle (1) is fixed at $0.15 \leq E/H \leq 0.30$.

9. The inlet nozzle according to claim 1, characterized in that a size ratio of an axial perturbation height S of the perturbation section (3) to an overall axial height H of the inlet nozzle (1) is fixed at $0.08 \leq S/H \leq 0.14$.

10. The inlet nozzle according to claim 1, characterized in that a size ratio of an axial outlet height A of the outlet section (4) to an axial discharge height Z of the discharge section (5) of the inlet nozzle (1) is fixed at $1.8 \leq A; Z \leq 2.8$.

* * * * *